US007093591B1

(12) United States Patent
Baxter

(10) Patent No.: US 7,093,591 B1
(45) Date of Patent: Aug. 22, 2006

(54) THERMO-CONDUCTIVE HOPPER FOR HOUSING PAINTBALL MOBILES IN A HEATED ENVIRONMENT

(76) Inventor: Jarrod Baxter, 1005 Greenwood St., Holmen, WI (US) 54636

( * ) Notice: Subject to any disclaimer, the term of this patent is extended or adjusted under 35 U.S.C. 154(b) by 30 days.

(21) Appl. No.: 11/029,933

(22) Filed: Jan. 6, 2005

(51) Int. Cl.
*F41B 11/02* (2006.01)

(52) U.S. Cl. ..... 124/49

(58) Field of Classification Search ..... 124/45, 124/48, 49, 50, 51.1, 73, 74
See application file for complete search history.

(56) References Cited

U.S. PATENT DOCUMENTS 5,794,606 A 8/1998 Deak
5,809,983 A 9/1998 Stoneking
5,816,232 A 10/1998 Bell
5,839,422 A 11/1998 Ferris
6,055,975 A 5/2000 Gallagher et al.
6,305,367 B1 10/2001 Kotsiopoulos et al.
6,418,919 B1 7/2002 Perrone
6,502,567 B1 1/2003 Christopher et al.
6,508,384 B1 1/2003 Tien et al.
6,725,852 B1 4/2004 Yokota et al.

*Primary Examiner*—John A. Ricci

(57) ABSTRACT

A hopper device includes a reservoir sized and shaped for defining a cavity therein and has first and second openings in fluid communication with the cavity. The first opening is disposed at a first end portion of the reservoir and the second opening is disposed subjacent to the first opening. An articulatable valve is connected to the first opening and is manually adaptable between open and closed positions for allowing and restricting flow of the paintball mobiles. A spout having opposed end portions is attached to the second opening and terminates away therefrom for assisting to dispense the paintball mobiles outwardly from the reservoir. The present invention further includes a mechanism for heating the reservoir and effectively maintaining an internal temperature of the cavity within the temperature range such that the paintball mobiles can be maintained at a liquefied state.

18 Claims, 4 Drawing Sheets

THERMO-CONDUCTIVE HOPPER FOR HOUSING PAINTBALL MOBILES IN A HEATED ENVIRONMENT

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a thermo-conductive hopper and, more particularly, to a thermo-conductive paintball hopper for housing paintball mobiles in a heated environment.

2. Prior Art

When engaged in any one of the numerous varieties of paintball games, one player attempts to hit another player with a spherical ball containing paint or some other type of marking material discharged from a compressed air or gas operated marking device. It is often advantageous to be able to fire rapidly and continuously in order to increase the chances of hitting an opponent with a paintball.

The paintball guns typically have magazines or hoppers attached to the paintball guns for holding only about one or two hundred paintballs. Due to safety concerns these projectiles must be in a pliable state, such that the outer covering may burst upon impact and spread the paint contained therein on the individual who has been hit. In colder weather, especially experienced during the winter months and the Northern states, this can create an undesirable situation where the temperature has dropped sufficiently such that the paintballs freeze. As a result, these solid projectiles cannot be fired properly from the guns and are more dangerous to the players because the outer covering will not burst upon impact. It would be advantageous to have a means of keeping the paintballs at a desired temperature different from the ambient temperature so that the projectiles do not freeze.

Accordingly, a need remains for a thermo-conductive paintball hopper for housing paintball mobiles in a heated environment in order to overcome the above-noted shortcomings. The present invention satisfies such a need by providing a hopper that is easy to use and allows an individual to play paintball in colder weather. Such a hopper allows owners of paintball ranges to keep their businesses open for longer periods of time, thus increasing their revenue. Furthermore, more players will become interested in this activity since it would no longer be limited to a short, seasonal time span, thereby justifying the buying of the equipment necessary to participate safely.

BRIEF SUMMARY OF THE INVENTION

In view of the foregoing background, it is therefore an object of the present invention to provide a thermo-conductive paintball hopper for housing paintball mobiles in a heated environment. These and other objects, features, and advantages of the invention are provided by a device for storing and maintaining paintball mobiles within a selected temperature range so that a user can effectively participate in an outdoor sporting activity when outdoor temperatures fall below a desired level.

The device includes a reservoir sized and shaped for being operably connected to a selected portion of a paintball gun and preferably formed from thermo-insulating material. Such a reservoir defines a cavity therein and has first and second openings in fluid communication with the cavity. The first opening is disposed at a first end portion of the reservoir and the second opening is disposed subjacent to the first opening. Such a second opening is medially situated between the first end portion and a second end portion of the reservoir such that gravitational forces can advantageously direct the paintball mobiles downwardly through the reservoir and towards the second opening during operating conditions. The first opening has a diameter greater than a diameter of the second opening so that the user can conveniently introduce the paintball mobiles at a faster rate than a dispensing rate of the second opening. An articulatable valve is connected to the first opening and is manually adaptable between open and closed positions for respectively allowing and restricting flow of the paintball mobiles through the reservoir.

A spout having opposed end portions is attached to the second opening and terminates away therefrom for conveniently assisting a user to dispense the paintball mobiles outwardly from the reservoir. Such a spout preferably includes a central portion defining a linear path therethrough and a flared coupling homogeneously attached to one of the end portions of the spout, thus providing a radially shaped conduit and directing the paintball mobiles through the central portion.

The present invention further includes a mechanism for heating the reservoir and effectively maintaining an internal temperature of the cavity within the temperature range such that the paintball mobiles housed within the reservoir can be maintained at a liquefied state independent of the outdoor temperature. Such a heating mechanism preferably includes at least one flexible heating element integrally attached to the reservoir and traveling along an outer surface of the reservoir such that the reservoir outer surface can advantageously provide a thermo-resistive barrier to the outside temperature. A controller switch is electrically coupled to the heating element for allowing a user to quickly and effectively toggle the heating mechanism between operating and non-operating modes.

The heating mechanism may also include a power supply source and a pigtail power cord for mating the power supply source to the controller. Such a power supply source generates an electrical energy that becomes converted to heat energy while passing through the heating element. Advantageously, the pigtail power cord is compressible into a helical pattern so that the user can freely participate in the outdoor sporting activity without accidentally detaching the power cord from the power supply source.

The device may further include a belt positionable about the user's body and includes a clip attached thereto for advantageously maintaining the power supply source at a substantially stable position about a user's waist. The device preferably further includes a holding pocket attached to the reservoir outer surface and extending outwardly therefrom for conveniently maintaining the power supply source at a substantially stable position and adjacent the reservoir.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
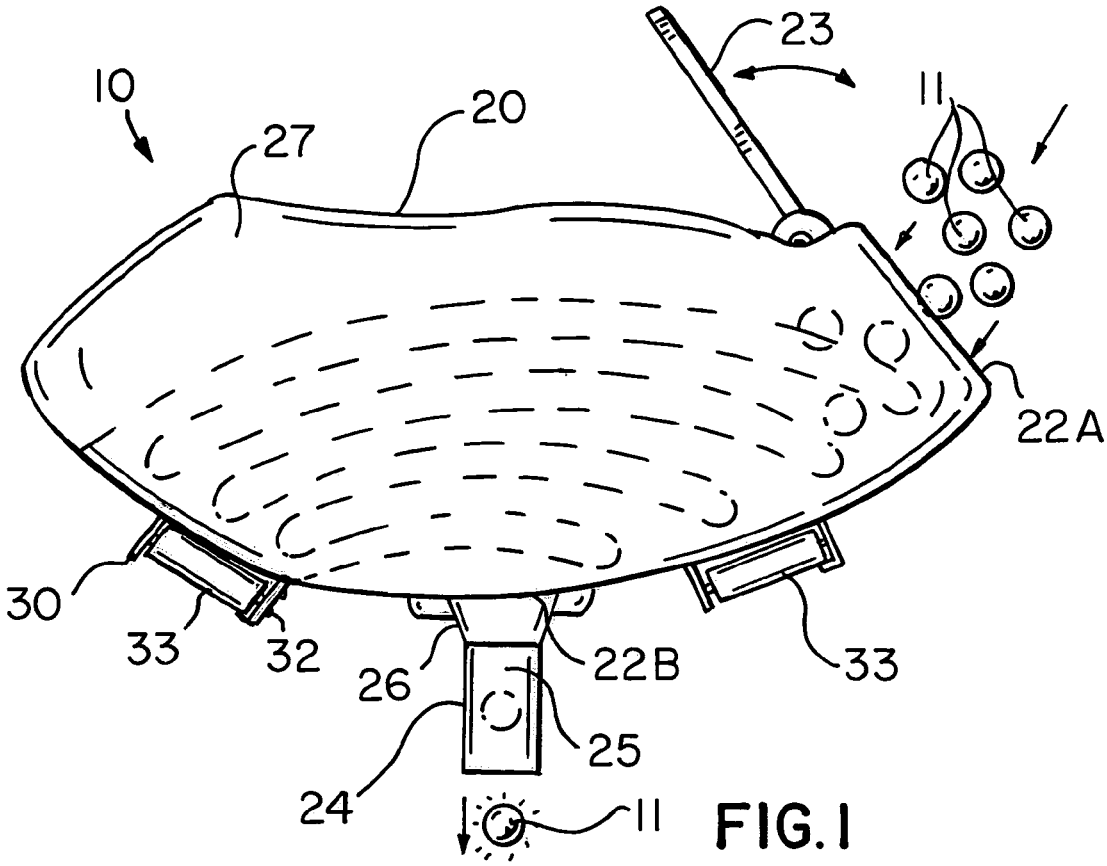
FIG. 1 is a side elevational view showing a thermo-conductive paintball hopper for housing paintball mobiles in a heated environment, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime and double prime numbers refer to like elements in alternate embodiments.

The device of this invention is referred to generally in FIGS. 1–6 by the reference numeral 10 and is intended to provide a thermo-conductive paintball hopper for housing paintball mobiles in a heated environment. It should be understood that the device 10 may be used to heat the projectiles in many different types of weather and game situations and should not be limited to use in only cold weather.

Referring initially to FIG. 1, the device 10 includes a reservoir 20 sized and shaped for being operably connected to a selected portion of a paintball gun and formed from thermo-insulating material. Of course, the reservoir 20 may be produced in a variety of different shapes, sizes and colors, as is well known to an individual of ordinary skill in the art. An alternate embodiment 10" of the reservoir 20" can be seen in FIGS. 5 and 6. The reservoir 20 defines a cavity 21 therein and has first 22A and second 22B openings in fluid communication with the cavity 21. The first opening 22A is disposed at a first end portion of the reservoir 20 and the second opening 22B is disposed subjacent to the first opening 22A. Such a second opening 22B is medially situated between the first end portion and a second end portion of the reservoir 20 such that gravitational forces can advantageously direct the paintball mobiles 11 downwardly through the reservoir 20 and towards the second opening 22B during operating conditions. This feature advantageously ensures a continuous flow of paintballs 11 into the firing mechanism of the paintball gun so a player may fire consecutive shots more rapidly.

The first opening 22A has a diameter greater than a diameter of the second opening 22B so that the user can conveniently introduce the paintball mobiles 11 at a faster rate than a dispensing rate of the second opening 22B. An articulatable valve 23 is connected to the first opening 22A and is manually adaptable between open and closed positions for respectively allowing and restricting flow of the paintball mobiles 11 through the reservoir 20.

Referring to FIGS. 1, 3, 4, 5 and 6, a spout 24 having opposed end portions is attached to the second opening 22B and terminates away therefrom for conveniently assisting a user to dispense the paintball mobiles 11 outwardly from the reservoir 20. Such a spout 24 includes a central portion 25 defining a linear path therethrough and a flared coupling 26 homogeneously attached to one of the end portions of the spout 24, thus providing a radially shaped conduit and directing the paintball mobiles 11 through the central portion 25.

Figure 2:
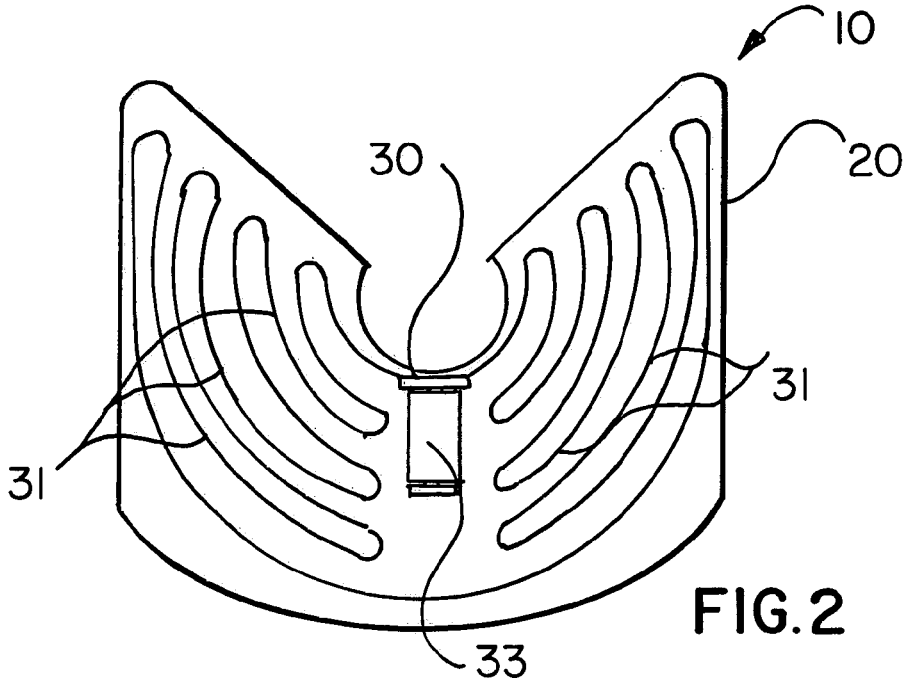
FIG. 2 is a rear elevational view of the reservoir shown in FIG. 1.
Figure 4:
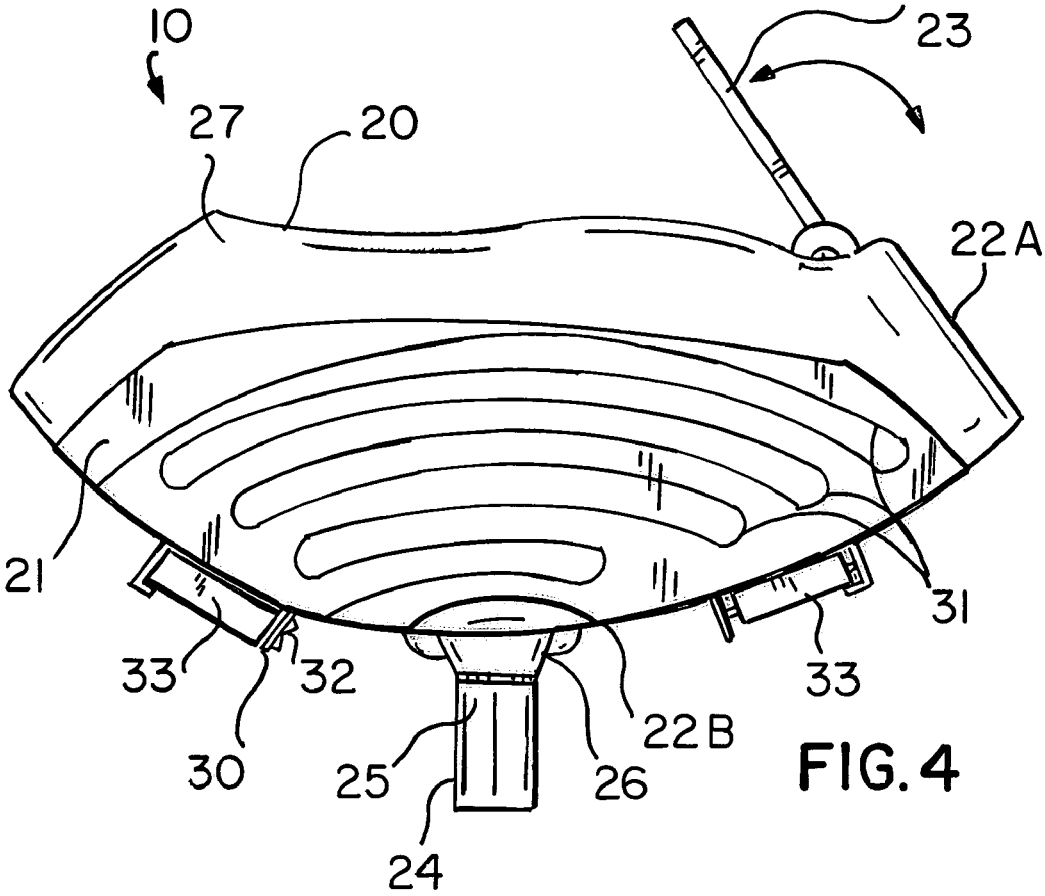
FIG. 4 is a partial cross-sectional view of the reservoir shown in FIG. 1, showing the cavity therein.

Referring to FIGS. 2 and 4, the present invention further includes a mechanism 30 for heating the reservoir 20 and effectively maintaining an internal temperature of the cavity 21 within the temperature range such that the paintball mobiles 11 housed within the reservoir 20 can be maintained at a liquefied state independent of the outdoor temperature, thus allowing game play even at cold temperatures where the paintball mobiles 11 would normally become frozen. Such a heating mechanism 30 includes at least one flexible heating element 31 integrally attached to the reservoir 20 and traveling along an outer surface 27 of the reservoir 20 such that the reservoir outer surface 27 can advantageously provide a thermo-resistive barrier to the outside temperature. A controller switch 32 is electrically coupled to the heating element 31 for allowing a user to quickly and effectively toggle the heating mechanism 30 between operating and non-operating modes. This feature allows the heating mechanism 30 to be turned on prior to game play, thus advantageously preheating the cavity 21 to ensure that the paintball mobiles 11 remain in a liquefied state.

Figure 3:
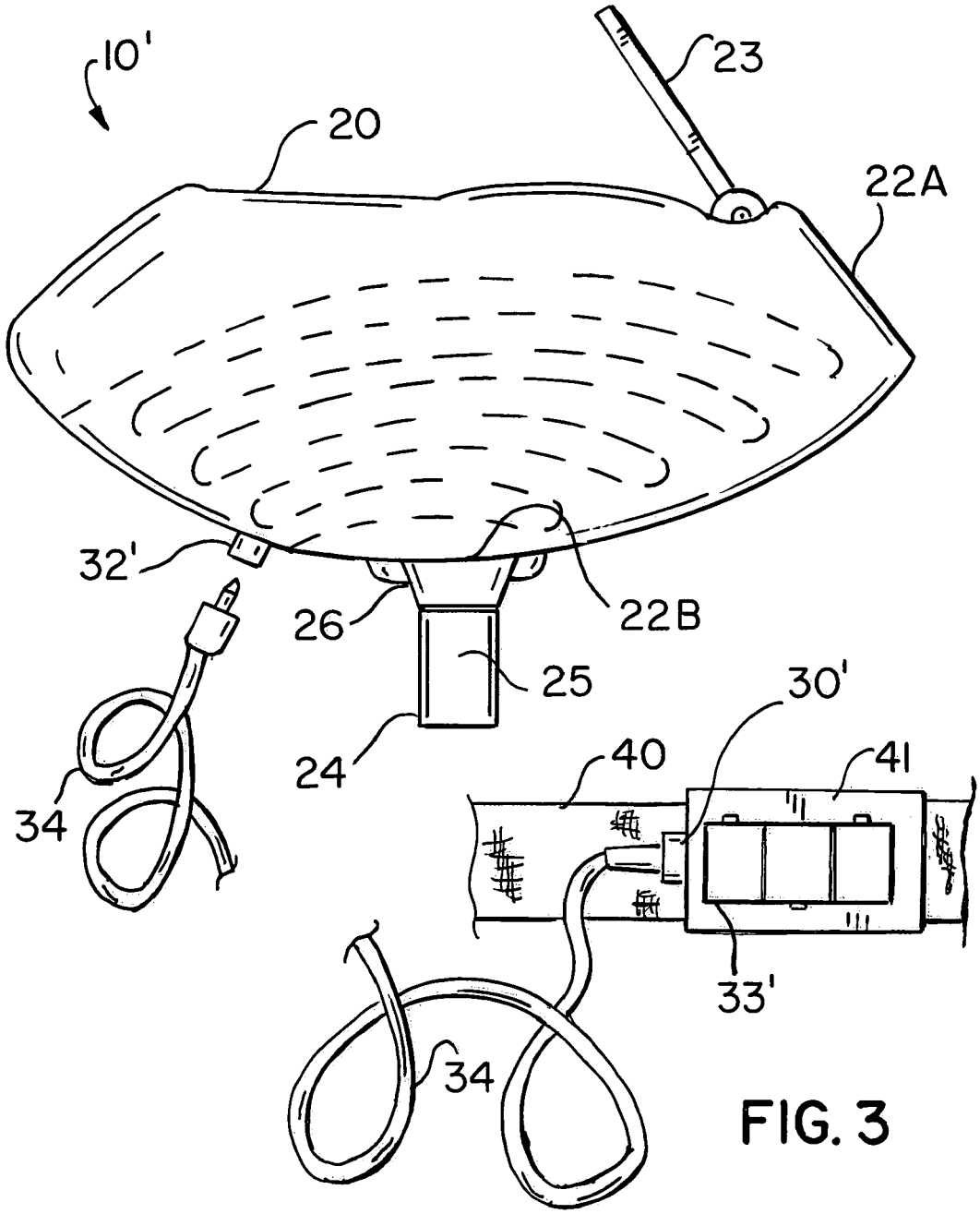
FIG. 3 is a side elevational view of the device shown in FIG. 1, showing the power cord and the power supply source attached to the belt.

Referring to FIG. 3, in an alternate embodiment 10', the heating mechanism 30' also includes a power supply source 33' and a pigtail power cord 34 for mating the power supply source 33' to the controller 32'. Such a power supply source 33' generates an electrical energy that becomes converted to heat energy while passing through the heating element 31. Advantageously, the pigtail power cord 34 is compressible into a helical pattern so that the user can freely participate in the outdoor sporting activity without accidentally detaching the power cord 34 from the power supply source 33', thereby causing the paintball mobiles 11 to dissipate heat and freeze, effectively ending game play activity for that player.

Still referring to FIG. 3, the device 10' further includes a belt 40 positionable about the user's body and includes a clip 41 attached thereto for advantageously maintaining the power supply source 33' at a substantially stable position about a user's waist.

Figure 6:
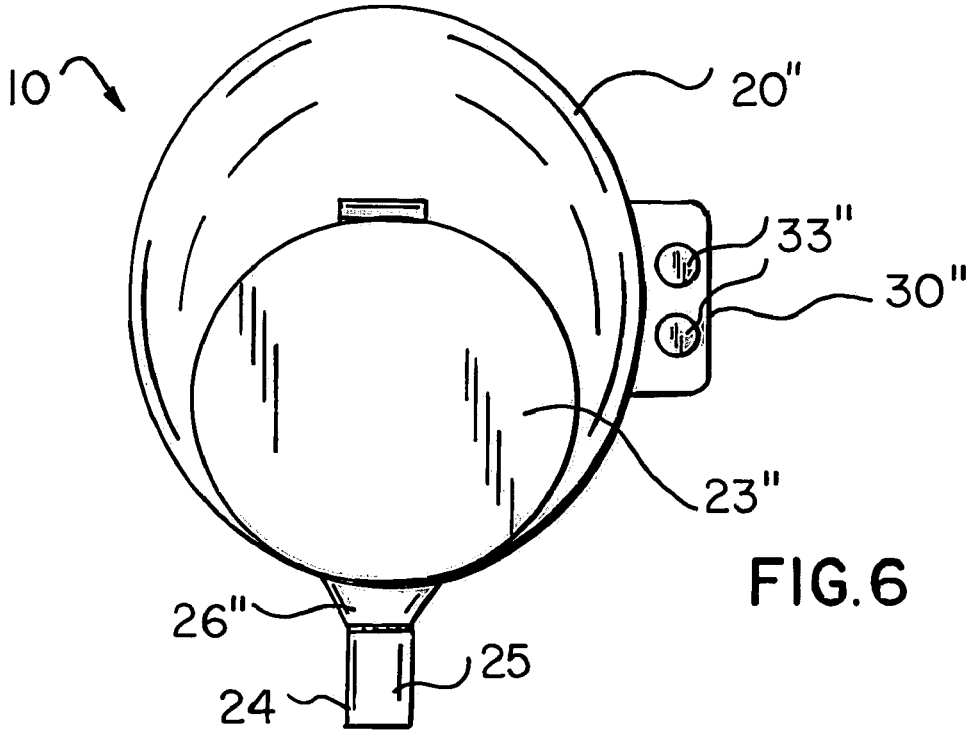
FIG. 6 is a front elevational view of the device shown in FIG. 5.
Figure 5:
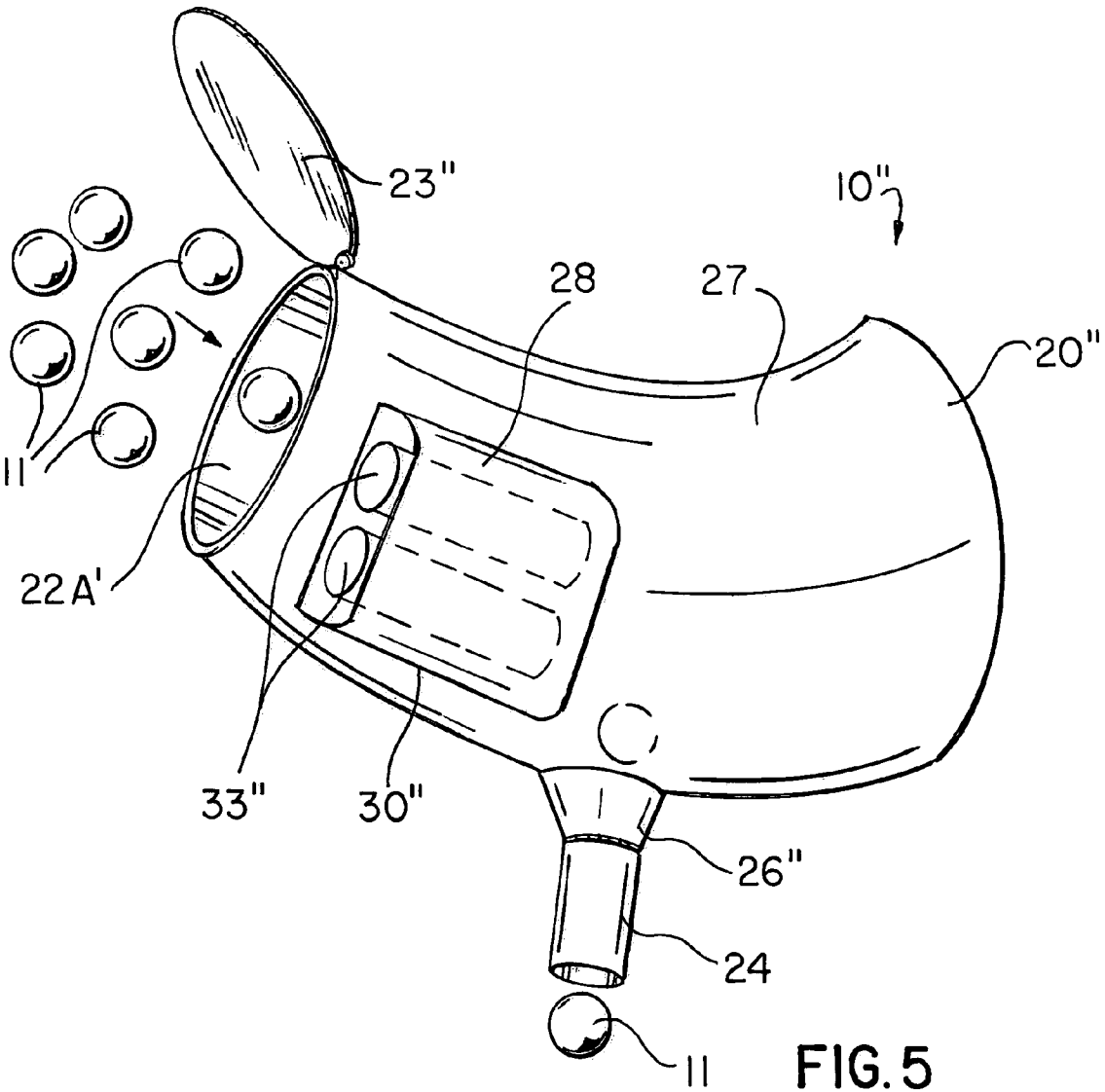
FIG. 5 is a side elevational view showing an alternate embodiment of the reservoir.

Referring to FIGS. 5 and 6, in yet another embodiment 10", a holding pocket 28 is attached to the reservoir outer surface 27' and extends outwardly therefrom for conveniently maintaining the power supply source 33" at a substantially stable position adjacent to the reservoir 20". The location of the power supply source 33" advantageously prevents same from interfering with game play activity.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A device for storing and maintaining paintball mobiles within a selected temperature range so that a user can effectively participate in an outdoor sporting activity when outdoor temperatures fall below a desired level, said device comprising:

a reservoir sized and shaped for being operably connected to a selected portion of a paintball gun, said reservoir defining a cavity therein and having first and second openings in fluid communication with the cavity, said first opening being disposed at a first end portion of said reservoir and said second opening being medially situated between said first end portion and a second end portion of said reservoir such that gravitational forces can direct the paintball mobiles downwardly through said reservoir and towards said second opening during operating conditions;

an articulatable valve connected to said first opening and being manually adaptable between open and closed positions for respectively allowing and restricting flow of the paintball mobiles through said reservoir;

a spout having opposed end portions attached to said second opening and terminating away therefrom for assisting a user to dispense the paintball mobiles outwardly from said reservoir; and means for heating said reservoir and maintaining an internal temperature of the cavity within the temperature range such that said paintball mobiles housed within said reservoir can be maintained at a liquefied state independent of the outdoor temperature.

2. The device of claim 1, wherein said heating means comprises:

at least one flexible heating element integrally attached to said reservoir and traveling along an outer surface of said reservoir such that said reservoir outer surface can provide a thermo-resistive barrier to the outside temperature; and a controller switch electrically coupled to said heating element for allowing a user to quickly and effectively toggle said heating means between operating and non-operating modes; and a power supply source and a pigtail power cord for mating said power supply source to said controller, said power supply source for generating an electrical energy that becomes converted to heat energy while passing through said heating element, said pigtail power cord being compressible into a helical pattern so that the user can freely participate in the outdoor sporting activity without accidentally detaching said power cord from said power supply source.

3. The device of claim 2, further comprising: a belt positionable about the user's body and including a clip attached thereto for maintaining said power supply source at a substantially stable position about a user's waist.

4. The device of claim 2, further comprising: a holding pocket attached to said reservoir outer surface and extending outwardly therefrom for maintaining said power supply source at a substantially stable position and adjacent said reservoir.

5. The device of claim 1, wherein said spout comprises:

a central portion defining a linear path therethrough; and a flared coupling homogeneously attached to one said end portions of said spout for providing a radially shaped conduit and directing the paintball mobiles through said central portion.

6. The device of claim 1, wherein said reservoir is formed from thermo-insulating material.

7. A device for storing and maintaining paintball mobiles within a selected temperature range so that a user can effectively participate in an outdoor sporting activity when outdoor temperatures fall below a desired level, said device comprising:

a reservoir sized and shaped for being operably connected to a selected portion of a paintball gun, said reservoir defining a cavity therein and having first and second openings in fluid communication with the cavity, said first opening being disposed at a first end portion of said reservoir and said second opening being disposed subjacent said first opening, said second opening being medially situated between said first end portion and a second end portion of said reservoir such that gravitational forces can direct the paintball mobiles downwardly through said reservoir and towards said second opening during operating conditions;

an articulatable valve connected to said first opening and being manually adaptable between open and closed positions for respectively allowing and restricting flow of the paintball mobiles through said reservoir;

a spout having opposed end portions attached to said second opening and terminating away therefrom for assisting a user to dispense the paintball mobiles outwardly from said reservoir; and means for heating said reservoir and maintaining an internal temperature of the cavity within the temperature range such that said paintball mobiles housed within said reservoir can be maintained at a liquefied state independent of the outdoor temperature.

8. The device of claim 7, wherein said heating means comprises:

at least one flexible heating element integrally attached to said reservoir and traveling along an outer surface of said reservoir such that said reservoir outer surface can provide a thermo-resistive barrier to the outside temperature; and a controller switch electrically coupled to said heating element for allowing a user to quickly and effectively toggle said heating means between operating and non-operating modes; and a power supply source and a pigtail power cord for mating said power supply source to said controller, said power supply source for generating an electrical energy that becomes converted to heat energy while passing through said heating element, said pigtail power cord being compressible into a helical pattern so that the user can freely participate in the outdoor sporting activity without accidentally detaching said power cord from said power supply source.

9. The device of claim 8, further comprising: a belt positionable about the user's body and including a clip attached thereto for maintaining said power supply source at a substantially stable position about a user's waist.

10. The device of claim 8, further comprising: a holding pocket attached to said reservoir outer surface and extending outwardly therefrom for maintaining said power supply source at a substantially stable position and adjacent said reservoir.

11. The device of claim 7, wherein said spout comprises:

a central portion defining a linear path therethrough; and a flared coupling homogeneously attached to one said end portions of said spout for providing a radially shaped conduit and directing the paintball mobiles through said central portion.

12. The device of claim 7, wherein said reservoir is formed from thermo-insulating material.

13. A device for storing and maintaining paintball mobiles within a selected temperature range so that a user can effectively participate in an outdoor sporting activity when outdoor temperatures fall below a desired level, said device comprising:

a reservoir sized and shaped for being operably connected to a selected portion of a paintball gun, said reservoir defining a cavity therein and having first and second openings in fluid communication with the cavity, said first opening being disposed at a first end portion of said reservoir and said second opening being disposed subjacent said first opening, said second opening being medially situated between said first end portion and a second end portion of said reservoir such that gravitational forces can direct the paintball mobiles downwardly through said reservoir and towards said second opening during operating conditions, said first opening having a diameter greater than a diameter of said second opening so that the user can introduce the paintball mobiles at a faster rate than a dispensing rate of said second opening;

an articulatable valve connected to said first opening and being manually adaptable between open and closed positions for respectively allowing and restricting flow of the paintball mobiles through said reservoir;

a spout having opposed end portions attached to said second opening and terminating away therefrom for assisting a user to dispense the paintball mobiles outwardly from said reservoir; and means for heating said reservoir and maintaining an internal temperature of the cavity within the temperature range such that said paintball mobiles housed within said reservoir can be maintained at a liquefied state independent of the outdoor temperature.

14. The device of claim 13, wherein said heating means comprises:

at least one flexible heating element integrally attached to said reservoir and traveling along an outer surface of said reservoir such that said reservoir outer surface can provide a thermo-resistive barrier to the outside temperature; and a controller switch electrically coupled to said heating element for allowing a user to quickly and effectively toggle said heating means between operating and non-operating modes; and a power supply source and a pigtail power cord for mating said power supply source to said controller, said power supply source for generating an electrical energy that becomes converted to heat energy while passing through said heating element, said pigtail power cord being compressible into a helical pattern so that the user can freely participate in the outdoor sporting activity without accidentally detaching said power cord from said power supply source.

15. The device of claim 14, further comprising: a belt positionable about the user's body and including a clip attached thereto for maintaining said power supply source at a substantially stable position about a user's waist.

16. The device of claim 14, further comprising: a holding pocket attached to said reservoir outer surface and extending outwardly therefrom for maintaining said power supply source at a substantially stable position and adjacent said reservoir.

17. The device of claim 13, wherein said spout comprises:

a central portion defining a linear path therethrough; and a flared coupling homogeneously attached to one said end portions of said spout for providing a radially shaped conduit and directing the paintball mobiles through said central portion.

18. The device of claim 13, wherein said reservoir is formed from thermo-insulating material.

* * * * *